US008137032B2

(12) United States Patent
Grocholewski et al.

(10) Patent No.: US 8,137,032 B2
(45) Date of Patent: Mar. 20, 2012

(54) ANCHOR WITH GROUT JACKET

(75) Inventors: Marek Grocholewski, Poznan (PL); Charles Bitz, Urdorf (CH); Roger Steiert, Rudolfstetten-Friedslisberg (CH); Rëmy Wittmann, Altkirch (FR); Casimir Bartkowski, Morschwiller le Bas (FR)

(73) Assignee: Minova International Limited, Chesterfield, Derbyshire (GB)

( * ) Notice: Subject to any disclaimer, the term of this patent is extended or adjusted under 35 U.S.C. 154(b) by 179 days.

(21) Appl. No.: 12/477,316

(22) Filed: Jun. 3, 2009

(65) Prior Publication Data

US 2010/0003088 A1 Jan. 7, 2010

(30) Foreign Application Priority Data

Dec. 19, 2006 (DE) ..... 10 2006 059 891
Dec. 19, 2007 (EP) ..... 07254935

(51) Int. Cl.
*E21D 20/02* (2006.01)

(52) U.S. Cl. ..... 405/259.5; 405/259.4

(58) Field of Classification Search ..... 405/259.1, 405/259.3, 259.4, 259.5, 259.6
See application file for complete search history.

(56) References Cited

U.S. PATENT DOCUMENTS

| | | | | |
|---|---|---|---|---|
| 3,302,410 | A | 2/1967 | Chalmers | |
| 3,971,177 | A * | 7/1976 | Endo | 405/259.5 |
| 4,056,036 | A * | 11/1977 | Kamann et al. | 405/259.5 |
| 4,360,292 | A | 11/1982 | Keeler et al. | |
| 4,440,526 | A * | 4/1984 | Koppers et al. | 405/259.5 |
| 4,576,524 | A * | 3/1986 | Heintzmann et al. | 405/259.5 |
| 4,630,971 | A * | 12/1986 | Herbst et al. | 405/259.5 |
| 4,648,753 | A * | 3/1987 | Stephan | 405/259.5 |
| 4,850,746 | A * | 7/1989 | Finsterwalder et al. | 405/259.5 |
| 4,971,493 | A * | 11/1990 | Herbst et al. | 405/259.5 |
| 4,984,937 | A * | 1/1991 | Karpellus | 405/259.1 |
| 5,636,945 | A * | 6/1997 | Nes | 405/259.5 |
| 6,474,910 | B2 * | 11/2002 | Lay | 405/259.4 |
| 7,381,013 | B1 * | 6/2008 | Rataj et al. | 405/259.5 |
| 2001/0046418 | A1 | 11/2001 | Lay | |
| 2006/0153645 | A1 * | 7/2006 | Rataj et al. | 405/259.5 |

(Continued)

FOREIGN PATENT DOCUMENTS

DE 20 19 533 11/1971

(Continued)

OTHER PUBLICATIONS

European Search Report for EP 07 25 4935.5 dated Dec. 30, 2008.

*Primary Examiner* — Frederick L Lagman
(74) *Attorney, Agent, or Firm* — Nixon & Vanderhye P.C.

(57) ABSTRACT

An anchor 1 for consolidating non-cohesive rock layers or for connecting them to solid rock 2 primarily has the necessary components for realising a stressed or expansion anchor. Furthermore, when a conventional domed plate 10 is used, which reliably transmits the necessary stress forces, it is possible additionally to bond the anchor bar 4 in the drill hole 3 after stressing. To this end, the anchor bar 4 is either constructed with a connecting tube 22 with distributor head 24 or the sheathing tube 11 comprises a top tube 50, these both fulfilling the task of conveying the grout bonding material 12 reliably from the drill hole mouth end of the anchor bar 4 to the rock end 5A and then diverting it there and returning it to the drill hole mouth, so ensuring complete fixing and sheathing of the anchor bar 4 in the drill hole 3.

24 Claims, 3 Drawing Sheets

U.S. PATENT DOCUMENTS

Figure 1:
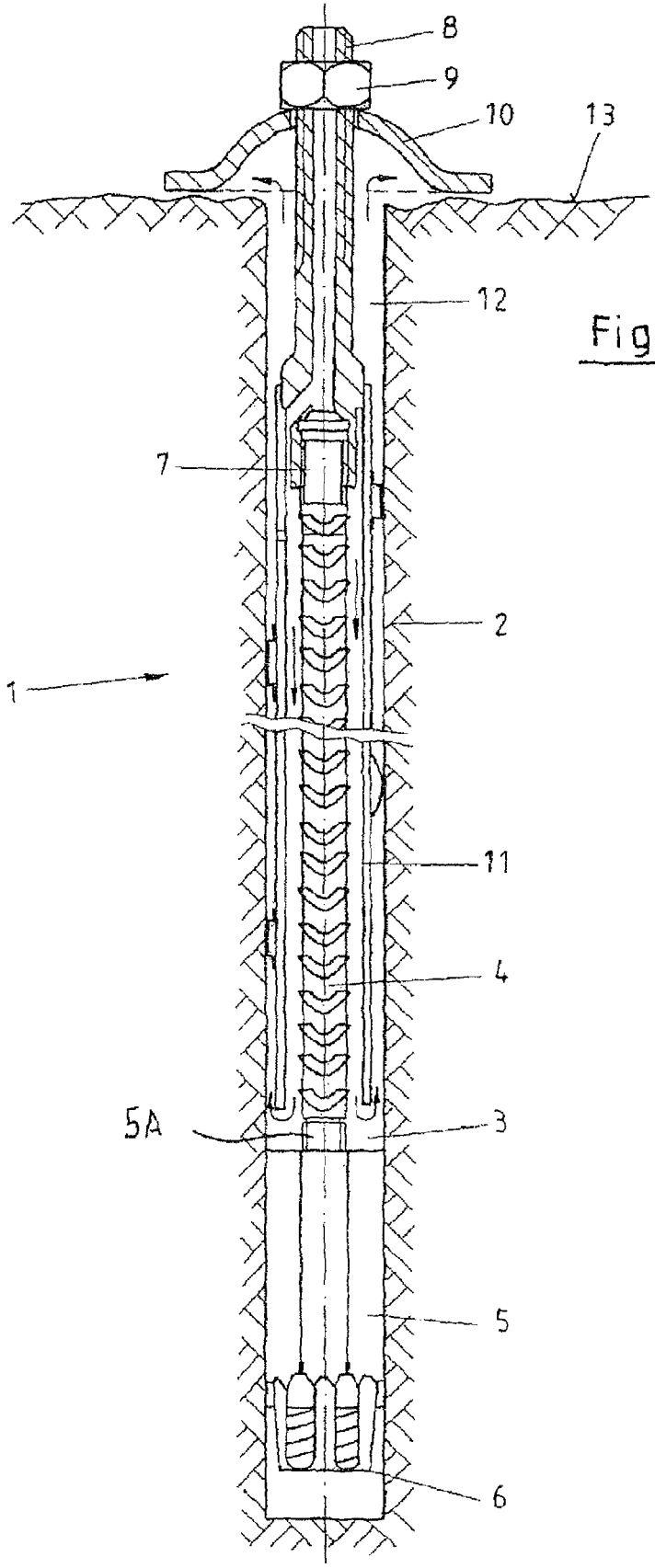

| | | | | |
|---|---|---|---|---|
| 2006/0204341 | A1 * | 9/2006 | Kanflod et al. | 405/259.5 |
| 2009/0052995 | A1 * | 2/2009 | Eriksson et al. | 405/259.5 |

FOREIGN PATENT DOCUMENTS

| | | |
|---|---|---|
| DE | 33 39 339 | 5/1985 |
| DE | 195 12 122 | 10/1996 |
| DE | 10 2006 059 891 | 6/2008 |
| EP | 0 317 547 | 5/1989 |
| EP | 1 939 394 | 7/2008 |
| FR | 2 077 119 | 10/1971 |
| WO | WO 2004/106700 | 12/2004 |

* cited by examiner

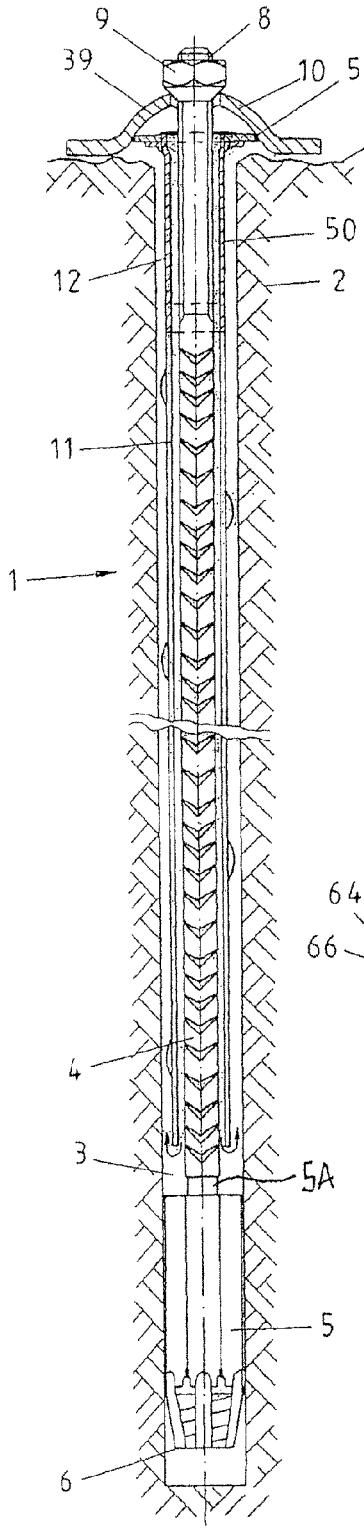
Fig.3
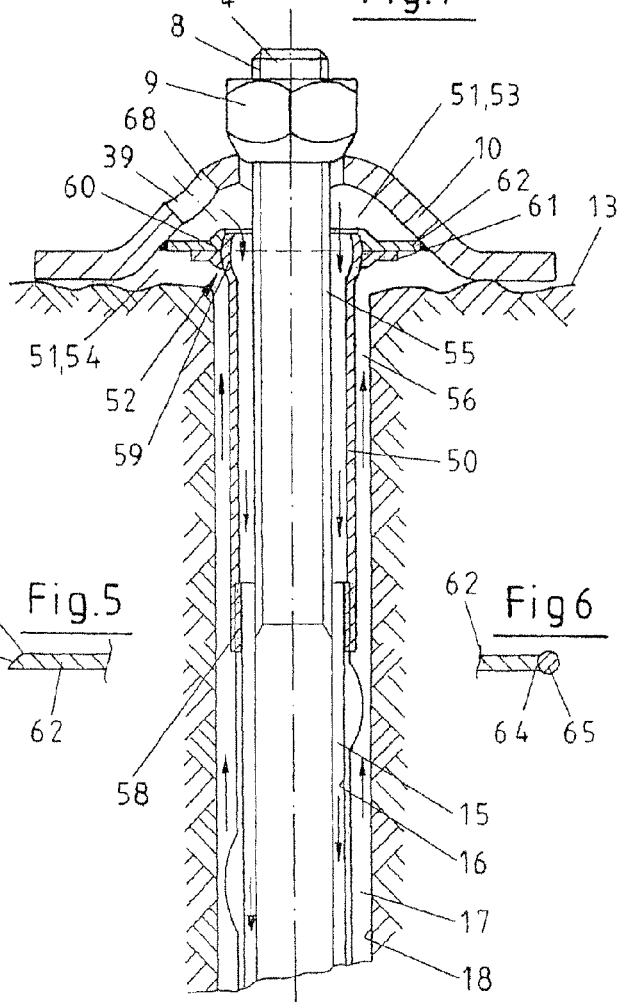
Fig.4
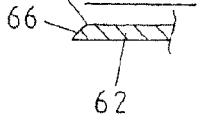
Fig.5
Fig 6

ANCHOR WITH GROUT JACKET

The invention relates to an anchor for consolidating non-cohesive rock layers or for connecting them to solid rock which anchor comprises an anchor bar having a rock end and an opposite bar end, a thread, anchor nut and domed plate arranged at the opposite bar end and a sheathing tube surrounding the anchor bar at a distance therefrom and extending roughly as far as the rock end wherein the sheathing tube may be filled from the bar end with grout bonding material to such an extent that the cavity between the anchor bar and the inner side of the sheathing tube and also the jacket space between the outer wall and the drill hole wall are filled with the grout bonding material.

Such an anchor is known in principle from DE 693 17 784 T2. In the case of this known anchor construction, it is pointed out that tubular anchors with an expansion bushing were already known beforehand, but that it is more advantageous on cost grounds and also for reasons of statics to use anchor bars in which the additional protective jacket is introduced by grout bonding material in such a way that the anchor bar is then completely sheathed by the grout bonding material. To this end, a sheathing tube is used, which is provided with a special anchor head, which makes it possible to pump grout bonding material down the anchor bar as far as the expansion bushing, in order then to divert it and return it to the drill hole mouth. This makes it possible to fill the drill hole completely with the anchor bar. In order to be able to guide the grout bonding material purposefully as described, the upper end of the sheathing tube is connected to a so-called supporting element, which is of ball-shaped or spherical construction and comprises a hole through which the mortar or grout bonding material may be pumped in in such a way that it arrives first of all in the cavity between anchor bar and sheathing tube inner side, in order then also to fill the remaining jacket space between the outer wall of the sheathing tube and the drill hole wall after deflection. This special construction requires a special embodiment of the so-called domed plate, in that the latter consists on the one hand of the so-called supporting element and on the other hand of the so-called flange part, the supporting element also being known as a pressure ball. This pressure ball is pressed against the flange part by the anchor nut, in order to apply the necessary forces on activation of the expansion anchor. A disadvantage is that this now two-part domed plate is doubly weakened, i.e. on the one hand by its annular, relatively flat construction and the connection with the supporting element, also known as a pressure ball, and on the other hand by this pressure ball itself, which is weakened by the grouting hole and moreover in that it is constructed so as to be displaceable on the thread of the sheathing tube. For this reason, it is difficult permanently to maintain the necessary stress forces.

The object of the invention is therefore to provide an anchor with a conventional commercial domed plate absorbing high stress forces, which anchor simultaneously ensures purposeful introduction of the grout bonding material and reliable sheathing of the anchor bar.

The object is achieved according to the invention in that the bar end is provided with a connecting tube, which comprises an external thread for the anchor nut and a distributor head extending into the drill hole in the rock, which distributor head is constructed with a connection to the anchor bar and to the sheathing tube and with radial bores extending as far as the internal channel.

This connecting tube is in a way an extension of the actual anchor bar and needs to be of correspondingly stable construction. When the anchor is stressed, this connecting tube is simply incorporated into the stressing process in that the anchor nut is turned on the external thread of the connecting tube towards the domed plate. This domed plate comprises a conventional commercial, stable domed plate which effectively transmits forces, the so-called connecting tube also being used simultaneously as a feed member for the grout bonding material, in that the internal channel as such conveys the grout bonding material outwards via the radial bores and into the cavity between anchor bar and sheathing tube inner side. An advantage is the possibility of a reliable connection, since the corresponding end of the connecting tube has an external thread, as mentioned above, and thus even allows connection of an appropriate hose connector, such that the grout bonding material may be forced with any desired pressure into the drill hole. As is conventional, this grout bonding material is then diverted at the expansion element and then forced through the jacket space between outer wall and drill hole wall back into the cavity under the domed plate, such that reliable sheathing of the anchor bar is ensured and thus also effective corrosion protection over the entire length. If the cavity under the domed plate is also filled, the grout bonding material penetrates to the outside, such that it is clearly obvious to the user that the anchor bar is definitely additionally fixed and protected.

According to the invention, there is provided an anchor as defined in claim 1. According to the invention, there is also provided an anchor as defined in claim 11.

The anchor according to the invention is particularly for use in underground mining and tunneling or as a permanent anchor in geotechnics According to the invention, there is further provided an anchor for consolidating non-cohesive rock layers or for connecting them to solid rock, in particular for use in underground mining and tunneling or as a permanent anchor in geotechnics, consisting of an anchor bar with expansion element attached at the rock end, a thread, anchor nut and domed plate arranged at the opposite bar end and a sheathing tube surrounding the anchor bar at a distance therefrom and extending roughly as far as the expansion element, which sheathing tube may be filled from the bar end with grout bonding material to such an extent that the cavity between the anchor bar and the inner side of the sheathing tube and also the jacket space between the outer wall and the drill hole wall are filled with the grout bonding material, characterised in that the bar end is provided with a connecting tube, comprising an external thread for the anchor nut and a distributor head extending into the drill hole in the rock, which distributor head is constructed with a connection to the anchor bar and to the sheathing tube as well as with radial bores extending as far as the internal channel.

According to the invention, there is also provided an anchor for consolidating non-cohesive rock layers or for connecting them to solid rock, in particular for use in underground mining and tunneling, consisting of an anchor bar with a rock end and a domed plate arranged at the opposite bar end and a sheathing tube surrounding the anchor bar at a distance therefrom and extending roughly as far as the rock end, which sheathing tube may be filled from the bar end with grout bonding material to such an extent that a cavity between the anchor bar and an inner side of the sheathing tube and also a jacket space between an outer wall and a drill hole wall are filled with the grout bonding material, characterised in that the domed plate comprises a separating head, which is constructed to separate a cavity of the domed plate into a first subchamber and a second subchamber, wherein the first subchamber comprises an opening for receiving grout bonding material and is open towards internal space of the sheathing tube, while the second subchamber is connected to an annular space around the sheathing tube.

In some embodiments, the anchor bar has a thread and an anchor nut. In some embodiments the sheathing tube comprises a top tube, which is constructed to extend as far into the cavity of the domed plate. In some embodiments, the first subchamber is an upper subchamber and the second subchamber is a lower subchamber. In some embodiments, the opening in the first subchamber is a connection for a pump hose. In some embodiments, an expansion element is attached at the rock end of the anchor.

Secure fixing of the connecting tube to the bar end on the one hand and also to the sheathing tube is ensured in that the distributor head comprises an external connection thread for the sheathing tube and an internal thread for the anchor bar, wherein the external connection thread is constructed above and the internal thread below the radial bores. This special arrangement of external and internal thread ensures that the above-described cavity remains between the sheathing tube and the anchor bar, which cavity has then to be filled with the grout bonding material. The anchor bar itself is screwed into the distributor head, while the sheathing tube is screwed on externally. At the same time, it is ensured by the special outlet area of the radial bores that the pumped-in grout bonding material is also reliably forced through the internal channel and then the radial bores into the cavity provided.

Uniform, reliable guidance of the grout bonding material through the distributor head is further ensured in that the radial bores are constructed so as to extend obliquely towards the connecting tube end, the bore openings thereof being located somewhat below the thread end of the external connection thread. The grout bonding material is thus immediately directed in the right direction, and cannot anyway escape undesirably upwards because the external connection thread by means of which the sheathing tube and the distributor head are effectively connected together prevents this from happening.

To ensure that the cavity between anchor bar and sheathing tube inner side is of adequate size, the external connection thread takes the form of a coarse thread, wherein of course the corresponding thread associated with the sheathing tube takes the same form.

Backing up inside the distributor head or the entire connecting tube is prevented in that the diameters of the oblique radial bores are jointly greater than the diameter of the internal channel inside the connecting tube. Conventionally, two such radial bores are provided, without the stability of the connecting tube or of the distributor head being impaired thereby, but it is also feasible to manage with one such radial bore or indeed with three.

The necessary forces in particular on stressing of the anchor bar are transmitted or applied in that the connecting tube consists of a material corresponding to the material of the anchor bar. In this way, it is also possible to provide the required threads, so as to ensure a sufficiently secure connection between connecting tube and anchor bar on the one hand, as well as between connecting tube and sheathing tube. However, the sheathing tube consists as a rule of plastics, both to simplify handling of the overall system but also because said sheathing tube is subsequently completely surrounded by the grout bonding material and thus fits optimally into the overall system.

It has been explained above that the particular construction of the external connection thread ensures that grout bonding material cannot flow in the wrong direction, i.e. here in the direction of the drill hole mouth. By the same token, however, it is also ensured that the grout bonding material cannot flow through the internal thread, by means of which the anchor bar and the connecting tube are connected, but rather in directed manner through the radial bores, in that the internal channel is constructed to determine a sealing surface relative to the anchor bar at the point of transition to the internal thread. The corresponding shaping ensures a satisfactory sealing surface, and ensures that the correspondingly prestressed anchor or the anchor bar may also permanently fulfil its function.

In the present solution, the grout bonding material is introduced from above into the connecting tube and the internal channel thereof. It has already been indicated that a favourable option is provided for fixing the pump hose to the connecting tube; in detail, the end piece, comprising the external thread, of the connecting tube is constructed to constitute a connection for the pump hose. This means that the internal channel extends axially inside the end piece and thus also the entire connecting tube, such that in this way it is also possible to fix the hose or indeed some other connector to the top of the end piece in such a way that the grout bonding material may also be introduced with the required pressure without any risk of the pump hose connection coming undone and contamination occurring.

It is advantageous for the cavity under the domed plate to be filled completely with grout bonding material when the grouting process is terminated. This is achieved in particular in that the domed plate comprises a flat edge adjoining the dome thereof. Thus, a certain seal distance is predetermined, depending on the length or width of the flat edge. Only when the grout bonding material exits at the outer edge does the operating team know that they can terminate the grouting process.

Optimum integration of the sheathing tube into the grout bonding material is promoted in that the sheathing tube comprises, distributed over the length thereof, centring cams or centring flanks on the outer wall. At the same time, these provide protection against extraction, but above all ensure that the sheathing tube at all points observes a distance from the drill hole wall which ensures the necessary jacket space, via which the grout bonding material may flow in the direction of the drill hole mouth.

Another option for working with a stable domed plate and thus also wholly fulfilling the object addressed is one in which the sheathing tube comprises a top tube, which is constructed to extend as far as into the cavity of the domed plate and there comprises a separating head, which is constructed to separate the upper subchamber of the cavity from the lower subchamber, wherein the upper subchamber comprises the connection for the pump hose and is open towards the internal space of the sheathing tube while the lower subchamber is connected to the annular space or jacket space around the sheathing tube.

In the solution described, it is also advantageously possible to work with a stable, conventional commercial domed plate. As before, the domed plate is stressed via the correspondingly constructed anchor nut if the anchor nut is screwed, to be precise in the direction of the bottom of the drill hole, on the thread of the anchor bar, which is withdrawn appropriately far out of the drill hole. Separation of the cavity under the domed plate into the upper and the lower subchambers makes it possible to force the grout bonding material through the wall of the domed plate into the upper subchamber, whence the grout bonding material flows to the internal space of the sheathing tube, so as then to flow, after deflection, via the jacket space or annular space into the lower subchamber and thence to the outside, so as to signal to the operating team that the grouting process may be terminated. An advantage of this solution is that the anchor bar itself remains unchanged, i.e. does not have to be provided with an extension. In return, however, the domed plate is weakened, albeit only slightly, by the bore which has to be introduced into its wall for filling the upper subchamber with grout bonding material and thus initiating the pumping process or grouting process.

Precise guidance of the grout bonding material into the internal space of the cavity and then back out via the annular space is made possible in that the top tube and the sheathing tube have a corresponding screw connection. This means that the corresponding internal space or indeed the cavity between anchor bar and sheathing tube inner side is extended up as far as the separating head, such that the grout bonding material is conveyed correspondingly reliably without influencing or indeed blocking the upward or downward path in any way. It is also feasible for the separating head to be constructed so as to form the upper end of the sheathing tube, i.e. for the sheathing tube to extend correspondingly far upwards, such that the top tube actually consists merely of the separating head.

To ensure the necessary mobility in the anchor head area, the invention provides for the separating head to comprise an annular ball part, which may be swiveled to a limited degree in a bearing formed of a supporting ring and annular separating disc. Thus no rigid structure is formed which would make application to the not always flat rock wall more difficult. Instead, the domed plate and the annular separating disc may be so swiveled that reliable application against the rock wall is always achieved.

As has already been explained above, the actual anchor bar has to be connected directly to the domed plate or the domed plate is then stressed accordingly by means of the anchor nut on screwing on the anchor bar. Hence, the top tube does not need to absorb forces or, if it does, then only to a very insignificant degree, such that it is advantageous for the top tube with the separating head or the separating head alone to be made from polyethylene.

In order to separate the upper and the lower subchamber effectively and reliably from one another, provision is made for the annular separating disc to be provided at the outer edge with a sealing ring or to comprise a sealing bevel. It is also possible to connect, preferably weld, the annular separating disc to the domed plate. These solutions ensure reliable guidance of the grout bonding material via the upper subchamber and the lower subchamber, such that, as mentioned above, it may be straightforwardly and reliably detected when the anchor or the anchor bar is completely encapsulated.

This reliable detection is promoted in that the domed plate comprises a flat edge adjoining its dome and comprises a bore in the dome serving as an opening or connection. This bore ensures secure connection of the pump hose, so ensuring overall a problem-free filling process.

The necessary jacket space between outer wall and drill hole wall is also reliably achieved in this solution in that the sheathing tube is provided on the outer wall with centring cams distributed over its length.

The invention is distinguished in particular in that an anchor, specifically in the form of the known expansion anchor, may be realised with a grout bonding material sheathing, which fills the drill hole around the anchor bar completely, such that the frictional connection to the rock is achieved not only via the expansion anchor but also by the "bonded anchor". It is advantageous in particular that use may be made of a conventional domed plate, which ensures adequate transmission of the stress forces and ensures permanently reliable seating of the anchor. Thus, double action of such an anchor is ensured, said anchor as such also having the additional advantage that relatively cheap auxiliary means may be used for realisation purposes.

Figure 2:
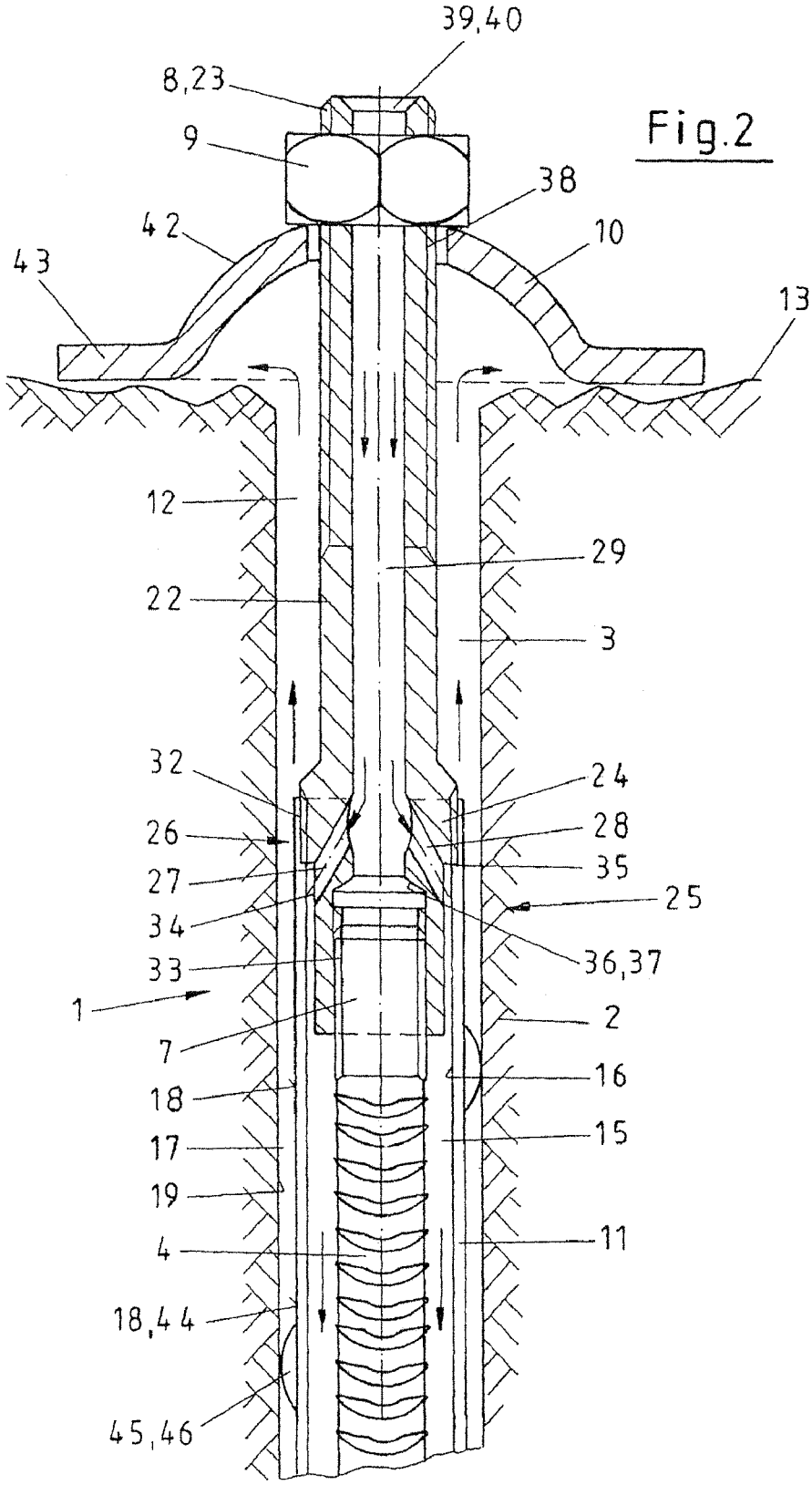

Further details and advantages of the subject matter of the invention will be revealed by the following description of the attached drawings, which show a preferred exemplary embodiment with the details and individual components necessary therefor. In the Figures:

FIG. 1 is a partially sectional view of an anchor stressed in a drill hole, with grout bonding material, FIG. 2 is an enlarged reproduction of the drill hole mouth area, FIG. 3 shows another embodiment of the anchor with top tube stressed in a drill hole, FIG. 4 is an enlarged reproduction of the drill hole mouth area, FIG. 5 is a separate view of the so-called annular separating disc; and FIG. 6 shows another embodiment of the edge area of this annular separating disc.

FIG. 1 shows an anchor 1, which has been introduced into the drill hole 3 in order to stabilise and consolidate the surrounding rock 2.

The anchor 1 consists of the up to 8 m long anchor bar, the expansion element 5 arranged at the bottom of the drill hole and the thread 8 with anchor nut 9 and domed plate 10 provided at the upper end. In an alternative embodiment of the anchor 1, it does not include the expansion element 5. The anchor bar has a rock end 5A and an opposite end 7. Tightening of the anchor nut 9 by means of the thread 8 towards the domed plate 10 and the surrounding rock 2 influences the expansion element 5 arranged at the bar tip in such a way that it expands towards the surrounding drill hole wall 19, such that the rock detritus located therebetween is compressed and consolidated. After this stressing process, the anchor bar 4 is sheathed with a grout bonding material 12, in order in this way to achieve bonding with the drill hole wall 19 and at the same time to achieve protection of the anchor bar 4 against corrosion.

The end 7 of the anchor bar 4 is connected to a connecting tube 22, which is included in the stressing process in the embodiment shown here in FIG. 1 and FIG. 2. To this end, the connecting tube 22 comprises an external thread 23, on which the anchor nut 9 may be displaced. Moreover, a distributor head 24 adjoins the connecting tube 22 or is a part thereof. The distributor head 24 comprises a connection 25 for the anchor bar 4 and a further connection 26 for the sheathing tube 11. The sheathing tube 11 is necessary in order to allow a channel for pumping the grout bonding material 12 in the direction of the expansion element 5 (or in the direction of rock end 5A if the expansion element 5 is not present) and thence back in the direction of the domed plate 10.

During grouting, as indicated by arrows, the grout bonding material 12 is firstly forced through the connecting tube 22, through the internal channel 29 therein, so as then to reach, via the radial bores 27, 28, the cavity 15 between anchor bar 4 and sheathing tube inner side 16. In the area of the expansion element 5 (or in the area of rock end 5A if the expansion element 5 is not present), the grout bonding material 12 is then diverted, so as to flow back via the jacket space 17 between outer wall 18 and drill hole wall 19 in the direction of the domed plate 10. It then fills the cavity under the domed plate 10, so as then to flow along the rock wall 13, such that the operating team may detect that the grouting process may now be terminated.

An enlarged reproduction of the anchor bar head is shown in FIG. 2. This clearly shows the connecting tube 22, which is connected to the anchor bar 4 and also the domed plate 10. To this end, the connecting tube 22 has an external connection thread 32, which matches the corresponding thread at the upper end of the sheathing tube 11. The internal thread 33 provided in the distributor head 24 serves for connection to the anchor bar 4. This internal thread 33 develops in the area of the distributor head 24 into two radial bores 27, 28, wherein the bore opening 34 thereof is located between the external connection thread 32 or the thread end 35 and the transition 36 between distributor head 24 and anchor bar 4 in such a way that an annular cavity 15 forms, which receives grout bonding material 12 from the internal channel 29 and the radial bores 27, 28. In the area of the transition 36, a sealing surface 37 is determined, which allows effective sealing relative to the end of the anchor bar 4.

At the end piece 38 of the connecting tube 22 there is provided the anchor nut 9, which ensures that the domed plate 10 is pressed against the rock wall 13 and thus ensures that the anchor bar 4 is stressed towards the expansion element 5. The internal channel 29 comprises a connection 39 at the connecting tube end 40 for the pump hose, not shown. The thread 8 for the anchor nut 9 may advantageously also be used to secure the pump hose effectively.

The domed plate 10 is a conventional commercial domed plate, which comprises a corresponding dome 42 and a flat edge 43.

As has already been mentioned, the grouting material 12 is conveyed via the connection 39 into the internal channel 29, so as then to arrive, via the radial bores 27, 28, in the cavity between sheathing tube inner side 16 and anchor bar 4. Here the grout bonding material 12 flows on as far as the expansion element 5 (or as far as rock end 5A if the expansion element 5 is not present), where it is diverted and then flows back upwards along the outer wall 44 through the jacket space designated 17. The outer wall 44 of the sheathing tube 11 is provided with centring cams 45 or centring flanks 46 distributed over its length, so as always effectively to hold open a sufficiently large jacket space 17 and to ensure that the grout bonding material 12 ultimately also effectively fills the cavity 51 under the dome 42 of the domed plate 10.

Guidance of the grout bonding material 12 is also realised in the construction according to FIGS. 3 to 6 in such a way that weakening of the domed plate 10 does not occur. Moreover, reliable guidance of the grout bonding material 12 is realised by the special construction of the top tube 50 used. In the embodiment portrayed in FIGS. 3 to 6, the actual anchor bar 4 is constructed so as to protrude beyond the rock wall 13, wherein the cavity 51 under the dome 42 of the domed plate 10 is subdivided by means of a separating head 52 into an upper subchamber 53 and a lower subchamber 54. In this way, the grout bonding material 12 introduced via the bore 68 in the wall of the domed plate 10 may flow via the upper subchamber 53 into the internal space 55 and then be deflected thereby so as to flow back through the annular space 56 into the lower subchamber 54. Complete sheathing of the anchor bar 4 is ensured in this way. The top tube 50 has a screw connection 58 for connection of the sheathing tube 11, such that this top tube 50 in practice constitutes an extension of the sheathing tube 11. At the upper end this top tube 50 widens out into an annular ball part 59, while a supporting ring 61 and an annular separating disc 62 form a bearing 60, so as to allow a swivel movement. The outer edge 64 of the annular separating disc 62 is generally welded to the inside of the dome 42, such that the entire domed plate 10 may be swiveled about the corresponding bearing 60 or the annular ball part 59. However, it is also feasible to provide the outer edge 64 with a sealing ring 65 or a sealing bevel 66, so as to allow an effective seal between upper subchamber 53 and lower subchamber 54.

Both solutions have therefore proven advantageous because, in the case of an optimum embodiment of a stressed anchor, the latter may in practice be combined with a bonded anchor, by sheathing it completely through skilful guidance of the grout bonding material 12 and connecting it to the drill hole wall 19.

All the stated features, including those revealed solely by the drawings, are regarded as essential to the invention both alone and in combination.

The invention claimed is:

1. An anchor for consolidating non-cohesive rock layers which anchor comprises:

an anchor bar with a rock end, a thread, anchor nut and domed plate arranged at opposite bar end, and a sheathing tube surrounding the anchor bar at a distance therefrom and extending roughly as far as the rock end, which sheathing tube may be filled from the bar end with grout bonding material to such an extent that a cavity between the anchor bar and the inner side of the sheathing tube and also a jacket space between the outer wall and the drill hole wall are filled with the grout bonding material, wherein the bar end is provided with a connecting tube comprising an external thread for the anchor nut and a distributor head extending into the drill hole in the rock, which distributor head is constructed with a connection to the anchor bar and to the sheathing tube as well as with radial bores extending as far as an internal channel, and wherein the internal channel is constructed so as to determine a sealing surface relative to the anchor bar at a point of transition to an internal thread.

2. An anchor according to claim 1, wherein the distributor head comprises an external connection thread for the sheathing tube and an internal thread for the anchor bar, the external connection thread being provided above and the internal thread below the radial bores.

3. An anchor according to claim 2, wherein the radial bores are constructed so as to extend obliquely relative to the connecting tube endue, the bore openings being located somewhat below the thread end of the external connection thread.

4. An anchor according to claim 2, wherein the external connection thread takes the form of a coarse thread.

5. An anchor according to claim 1, wherein diameters of the oblique radial bores are jointly greater than the diameter of the internal channel.

6. An anchor according to claim 1, wherein the connecting tube consists of a material corresponding to the material of the anchor bar.

7. An anchor according to claim 1, wherein the end piece, comprising the external thread, of the connecting tube is constructed to constitute a connection for the pump hose.

8. An anchor according to claim 1, wherein the domed plate comprises a flat edge adjoining the dome thereof.

9. An anchor according to claim 1, wherein the sheathing tube comprises, distributed over the length thereof, centring cams or centring flanks on an external wall (44).

10. An anchor for consolidating non-cohesive rock layers which anchor comprises:

an anchor bar with a rock end, a domed plate arranged at opposite bar end, and a sheathing tube surrounding the anchor bar at a distance therefrom and extending roughly as far as the rock end, which sheathing tube may be filled from the bar end with grout bonding material to such an extent that a cavity between the anchor bar and an inner side of the sheathing tube and also a jacket space between an outer wall and a drill hole wall are filled with the grout bonding material, wherein the domed plate comprises a separating head, which is constructed to separate a cavity of the domed plate into a first subchamber and a second subchamber, wherein the first subchamber comprises an opening for receiving grout bonding material and is open towards internal space of the sheathing tube while the second subchamber is connected to an annular space around the sheathing tube.

11. An anchor according to claim 10, wherein the anchor bar has a thread and an anchor nut.

12. An anchor according to claim 10, wherein the sheathing tube comprises a top tube, which is constructed to extend as far into the cavity of the domed plate.

13. An anchor according to claim 10, wherein the first subchamber is an upper subchamber and the second subchamber is a lower subchamber.

14. An anchor according to claim 10, wherein the opening in the first subchamber is a connection for a pump hose.

15. An anchor according to claim 12, wherein the top tube and the sheathing tube have a corresponding screw connection.

16. An anchor according to claim 10, wherein the separating head is constructed to form the upper end of the sheathing tube.

17. An anchor according to claim 10, wherein the separating head comprises an annular ball part, which may be swivelled to a limited degree in a bearing formed of a supporting ring and annular separating disc.

18. An anchor according to claim 12, wherein the top tube with the separating head or the separating head are made of polyethylene.

19. An anchor according to claim 17, wherein the annular separating disc is provided at the outer edge with a sealing ring or comprises a sealing bevel.

20. An anchor according to claim 10, wherein the domed plate (10) comprises a flat edge adjoining its dome and comprises a bore in the dome serving as the opening.

21. An anchor according to claim 10, wherein the sheathing tube is provided on the outer wall with centring cams distributed over its length.

22. An anchor according to claim 17, wherein the annular separating disc is connected, to the domed plate.

23. An anchor according to any one of the preceding claims, further comprising an expansion element attached at the rock end.

24. An anchor according to claim 22, wherein the annular separating disc is welded to the domed plate.

* * * * *

UNITED STATES PATENT AND TRADEMARK OFFICE

CERTIFICATE OF CORRECTION

PATENT NO. : 8,137,032 B2
APPLICATION NO. : 12/477316
DATED : March 20, 2012
INVENTOR(S) : Grocholewski et al.

It is certified that error appears in the above-identified patent and that said Letters Patent is hereby corrected as shown below:

Please delete Item "(30) Foreign Application Priority Data"

Signed and Sealed this
Third Day of July, 2012

David J. Kappos

David J. Kappos
*Director of the United States Patent and Trademark Office*